US007020615B2

(12) United States Patent
Vafin et al.

(10) Patent No.: US 7,020,615 B2
(45) Date of Patent: Mar. 28, 2006

(54) METHOD AND APPARATUS FOR AUDIO CODING USING TRANSIENT RELOCATION

(75) Inventors: Renat Vafin, Stockholm (SE); Richard Heusdens, Alkmaar (NL); Steven Leonardus Josephus Dimphina Elisabeth Van De Par, Eindhoven (NL); Willem Bastiaan Kleijn, Stocksund (SE)

(73) Assignee: Koninklijke Philips Electronics N.V., Eindhoven (NL)

( * ) Notice: Subject to any disclaimer, the term of this patent is extended or adjusted under 35 U.S.C. 154(b) by 733 days.

(21) Appl. No.: 10/003,052

(22) Filed: Nov. 2, 2001

(65) Prior Publication Data

US 2002/0120445 A1 Aug. 29, 2002

(30) Foreign Application Priority Data

| | | |
|---|---|---|
| Nov. 3, 2000 | (EP) | 00203857 |
| Apr. 27, 2001 | (EP) | 01201570 |
| May 3, 2001 | (EP) | 01201627 |
| Jul. 25, 2001 | (EP) | 01202826 |

(51) Int. Cl.
*G10L 19/00* (2006.01)

(52) U.S. Cl. ..... 704/500; 704/200.1; 704/502

(58) Field of Classification Search ..... 704/200.1, 704/229, 500, 501, 502
See application file for complete search history.

(56) References Cited

U.S. PATENT DOCUMENTS

| | | | | |
|---|---|---|---|---|
| 5,285,498 | A * | 2/1994 | Johnston | 381/2 |
| 5,636,324 | A * | 6/1997 | Teh et al. | 704/226 |
| 6,266,644 | B1 * | 7/2001 | Levine | 704/503 |
| 2002/0116199 | A1 * | 8/2002 | Wu et al. | 424/525 |

OTHER PUBLICATIONS

Levine, Scott N.; Smith, Julius O. III; A Slnes + Transients + Noise Audio Representation for Data Compression and Time/Pitch Scale Modifications; AES 105th Convention.*
An introduction to the Psychology of Hearing; Academic Press;1997.*
Purnhage, Heiko; Advances in Parametric Audio Coding; Proceedings of the 1999 IEEE Workshop oon Applications of Signal Processing to Audio and Acoustics, pp W99-1-W99-4.*

* cited by examiner

*Primary Examiner*—Tālivaldis Ivars Šmits
*Assistant Examiner*—Minerva Rivero

(57) ABSTRACT

An improved representation of transients in audio signals comprises modifying transient locations in such a way that a transient can occur only at a beginning of a sinusoidal segment. The modification procedure comprises the steps:
detecting a beginning and an end of a transient using an energy-based approach with two sliding rectangular windows;
moving samples between the beginning and the end of the transient to the locations specified by the segmentation used; and
time-warping the signal parts in between the transients in order to fill the intervals between the modified transients.

26 Claims, 6 Drawing Sheets

METHOD AND APPARATUS FOR AUDIO CODING USING TRANSIENT RELOCATION

FIELD OF THE INVENTION

BACKGROUND OF THE INVENTION

This invention relates to method of coding signals and to apparatus for storing, transmiting, receiving or reproducing signals.

A common method of storing audio signals is to use parametric coding to represent audio signals, especially at very low bit rates, typically in the region from 6 kbps to 90 kbps. Examples of the use of parametric coding used in this way are included in "Low bit rate high quality audio coding with combined harmonic and wavelet representation" in Proceedings of the IEEE International Conference on Acoustics, Speech and Signal Processing, Volume 2, pp 1045 to 1048, 1996; "Advances in Parametric Audio Coding" in Proceedings of the 1999 IEEE Workshop on Applications of Signal Processing to Audio and Acoustics, pp W99-1–W99-4, 1999; and "A 6 kbps to 85 kbps scalable audio coder" in Proceedings of the IEEE International Conference on Acoustics, Speech and Signal Processing, Volume II, pp 877–880, 2000. In these examples, a parametric audio coder is described, in which an audio signal is represented by a model, with parameters of the model being estimated and encoded. These examples use a parametric representation of an audio signal based on decomposition of an original signal into three components: a transient component, a tonal (sinusoidal) component, and a noise component. Each component is represented by a corresponding set of parameters, as described in the three documents above. A transient component of an audio signal can be characterized as an isolated element of the audio signal which is relatively short lived, and is represented by a sharp increase in energy of the audio signal.

It has been found that having a dedicated model for the transient component of an audio signal proves to be beneficial for parts of audio signals with sharp attacks, because sinusoidal and noise models cannot easily represent such perceptually important events and poor modeling can result in audible artifacts such as a pre-echo. A pre-echo occurs when the modeling error distributes the transient event to the samples before the transient beginning and when the resulted distortion is large enough to become audible. The distribution of the modeling error to the samples before the transient beginning results from the segment-by-segment analysis of an input signal in an audio coder. If a transient occurs in the middle of an analysis segment, then either a lot of coding resources are required in order to accurately model the transient, or the modeling error distributes to the whole analysis segment. Modeling error of the samples preceding a transient is typically perceptually more apparent than at samples after the transient, because of a weaker masking from the transient event itself.

In "Residual modeling in music analysis-synthesis" from Proceedings of the IEEE International Conference on Acoustics, Speech and Signal Processing, Volume 2, pp 1005–1008, 1996 it is shown that transient components cannot satisfactorily be represented by sinusoidal and noise models alone.

It has been shown previously in "Robust exponential modeling of audio signals" from Proceedings of the IEEE International Conference on Acoustics, Speech and Signal Processing, Volume 6, pp 3581–3584, 1998, that transients can be modeled efficiently using sinusoids with exponentially modulated amplitudes (referred to below as damped sinusoids). In the text below damping coefficients can be any real number, and positive values correspond to increasing amplitudes rather than to truly decreasing amplitudes. In "Robust exponential modeling of audio signals" (see above) an audio signal was analyzed on a segment-by-segment basis and each segment was represented as a sum of damped sinusoids. A problem arises with this type of coding when a transient starts in the middle of a given segment. Compared to the case where transient starts in the beginning of a segment, the number of damped sinusoids needed to model the transient well increases considerably. If a transient is not modeled properly, the modeling error is distributed over the whole of a given segment resulting in audible pre-echoes.

In the MPEG-1 Layer III audio coding algorithm, as described in "ISO-MPEG-1 Audio: a generic standard for coding of high-quality digital audio" in the Journal of the Audio Engineering Society, Volume 42, pp 780–792, October 1994. The segmentation is defined simply by the lengths of the long and short windows.

It is an object of the present invention to address the above mentioned disadvantages. To this end the invention provides a method of coding and an apparatus for coding as defined in the independent claims. Advantageous embodiments are defined in the dependent claims.

According to a first aspect of the present invention the coding of an input signal comprises:

estimating a location of at least one transients in a time segment of the input signal;

modifying the location of the transient so that the or each transient occurs at a specified location on a predetermined time scale to obtain a modified signal; and modeling the modified signal.

The use of restricted time segmentation in the form of a specified location on a predetermined time scale to provide the only locations for the transients advantageously reduces the number of bits needed to describe the segmentation. Also the modification procedure has lower computational cost compared to a full precision segmentation procedure.

Each transient is preferably re-located to a nearest specified location of a plurality of possible locations on the predetermined time scale.

The specified locations on the predetermined time scale may be defined by integer multiples of a predetermined minimum time segment size. The predetermined minimum time segment size may have a length in the range of approximately 1 millisecond (ms) to approximately 9 ms, most preferably in the range of approximately 4 ms to approximately 6 ms.

The use of a restricted time segmentation as described advantageously simplifies the modeling procedure significantly, if rate-distortion control is used to distribute coding resources between transient, sinusoidal and noise components of the input signal being modeled.

The modeling preferably uses damped sinusoids.

The audio signal is preferably sampled at a rate of approximately 5 to 50 kHz, most preferably 8, 16, 32, 44.1 or 48 kHz. The video signal is preferably sampled at a rate of approximately 5 to 20 MHz.

The restricted time segmentation may also be applied to tonal and/or noise components of an input signal.

The estimation of the location of transients may be carried out using an energy-based approach, preferably with a moving window method, most preferably using two sliding windows.

The use of an energy-based approach allows the advantageous estimation of both very short transients and longer transients.

The location of transients may involve the location of a beginning and an end of each transient.

Preferably each located transient is moved by a cut and paste method from its original location to begin at a location on the predetermined time scale.

The cut and paste method simply removes that part of the input signal identified as a transient and moves it to the new location. Thus the step is very simple to implement.

A remaining section of the input signal between two located and modified transients is preferably time-warped to fill the gap remaining following the relocation. The time-warp may be a lengthening or a shortening of said remaining section.

By using knowledge of sound perception, including pitch perception and temporal masking effects, the time-warping is a simple method with which to restore the remaining signal after modification of the transients.

The time-warping preferably preserves the amplitudes of edge-points of the modified signal, preferably by a band limited interpolation method.

The time-warp is preferably carried out by interpolation where the change in the fundamental frequency, $f_0$, of the remaining section is less than approximately 0.3%, most preferably less than approximately 0.2%.

Otherwise, the remaining section is preferably split in to a first length immediately after the modified transient and a second length. Preferably, the first length is approximately 8 ms to 12 ms, most preferably approximately 10 ms. The first length is preferably interpolated if the change of fundamental frequency caused is no more than approximately 1.6% to 2.4%, most preferably no more than approximately 2%. For the second length, the change of fundamental frequency is preferably not more than about 0.16% to 0.24%, most preferably approximately 0.2%.

Where the interpolation is insufficient to fill a gap in the remaining section an overlap-add procedure is preferably used.

The modification of the location of the or each transient may be performed using a transformation into a frequency domain, preferably with a discrete cosine transform. The resulting sinusoidal representation may then be analyzed for transient locations using a Hanning window. Preferably, the Hanning window has a length of approximately 512 samples (where a sample has a length of one divided by a sampling frequency of the input signal), preferably with an overlap between Hanning windows of 256 samples.

The input signal is preferably processed by dividing the input signal into a plurality of time segments. The time segments may have a length in the range of approximately 0.5 s to 2 s, preferably a length of approximately 1 s.

Adjacent time segments are preferably arranged to overlap, preferably by approximately 5% to approximately 15% of their length, more preferably the overlap is approximately 10% of the time segment length, which overlap may be approximately 0.1 s. Where a transient is located in an overlap of the adjacent time segments, the transient location is modified in the time segment in which the transient is most centrally located.

The provision of an overlap in adjacent time segments advantageously allows the selection of the time segment in which the transient is most centrally located, or more importantly furthest from the beginning or end of the time segment.

The invention extends to decoding audio or video signals coded according to the coding of the first aspect.

An apparatus according to an embodiment of the invention may be an audio device, e.g. a solid state audio device.

All of the features disclosed herein can be combined with any of the above aspects, in any combination.

Preferred embodiments of the invention of the invention provide coding signals which coding has a more simplified analysis procedure than has previously been described, coding signals which coding has a lower computational cost than equivalent methods, and coding signals which coding results in a reduction of the number of bits needed to describe a segmented signal.

Additional side information may be included in the bitstream to dewarp the signal at the decoder side. With the appropriate dewarping, temporal misalignment of stereo signals can be avoided.

BRIEF DESCRIPTION OF THE DRAWINGS

Specific embodiments of the present invention will now be described, by way of example, and with reference to the accompanying drawings, in which.

DETAILED DESCRIPTION OF THE INVENTION

Figure 4:
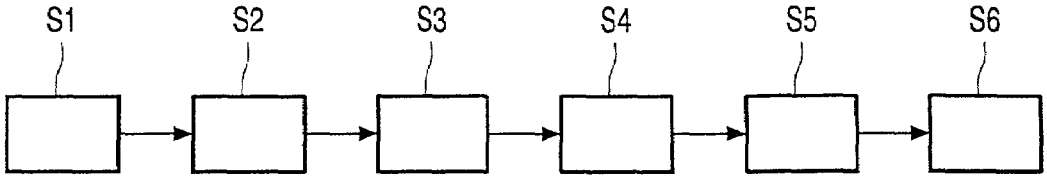
FIG. 4 is a flow diagram of the steps involved in the method of coding audio signals in the first embodiment.

The first method disclosed herein, and as shown in FIG. 4, uses a restricted time segmentation, in which segments of an audio signal are defined by integer multiples of a predefined minimum segment size, which in the example used is 5 ms, but of course this could vary. In view of the restricted time segmentation the transient component of the audio signal is modified such that transients can start only at the beginning of a segment. The modified signal is then modeled, in this example by using damped sinusoids. This results in an efficient representation of transients with damped sinusoids.

The coding of audio involves a first step of modifying the location of transient elements of the signal so that the transients can occur only at locations defined by a relatively coarse time grid, as described below in the discussion of experimental results. In order to modify the locations of transients in the audio signal the following steps are taken:

1. The transient component of an original audio signal is estimated and is subtracted from the original audio signal to form a residual signal.
2. The locations of the estimated transients are then modified in such a way that the transients can only occur at locations specified on a grid.

During the transient estimation and modification, it has been verified that when the modified transient signal is added to the residual signal obtained in step 1 above, there is no perceptual difference between the obtained signal and the original audio signal.

In order to modify the transient locations it is necessary to estimate the transient component of the original audio signal to be coded. It is possible to use different transient models in parametric coding of audio. One example which has been used is the transient model based on duality between the time and frequency domain presented in "Transient modeling synthesis: a flexible analysis/synthesis tool for transient signals", in Proceedings of the International Computer Music Conference, pp 25–30, 1997.

In more detail, the transient estimation model presented in the above reference is based on the duality between the time and the frequency domain. A delta impulse in the time domain corresponds to a sinusoid in the frequency domain. Furthermore, a sharp transient in the time domain corresponds to a frequency domain signal which can be represented efficiently by a sum of sinusoids. More specifically, the transients are estimated using the following steps.

1. A discrete cosine transform (DCT) is used to transform a time domain segment to the frequency domain. The segment size (equivalently, the DCT size) should be sufficiently large to ensure that a transient is a short event in time (thus, transformed to the frequency domain, it can be modeled efficiently by sinusoids). A block size of about 1 s has been found to be sufficient.
2. The frequency domain (DCT domain) signal is analysed with a sinusoidal model. One example which has been used is a consistent iterative sinusoidal analysis/synthesis with Hanning-windowed sinusoids, as described in "High quality consistent analysis-synthesis in sinusoidal coding", from Proceedings of the Audio Engineering Society $17^{th}$ Conference "High quality audio coding", pp 244–250, 1999.

The sinusoidal analysis of a DCT domain segment is done on a segment by segment basis. As a result, the DCT-domain segment is represented as $$S_i(l) = \sum_{j=1}^{J} h(l) A_{i,j} \cos\left(\omega_{i,j}\left(l\frac{L-1}{2}\right) - \phi_{i,j}\right), \quad l = 0, \ldots, L-1,\ i = 1, \ldots, I \tag{1}$$

where L is the length of the sinusoidal segments (the shift between sinusoidal segments is L/2). The length of the sinusoidal segments, L, is a small fraction of the DCT size, N. h(l) are samples of the Hanning window, and $\{A_{i,j}, \omega_{i,j}, \varnothing_{i,j}\}$ are amplitudes, frequencies and phases of the estimated sinusoids respectively. The index i denotes a particular sinusoidal segment within the DCT-domain segment, while the index j denotes a particular sinusoid within the sinusoidal segment. The information about the location of a transient in a time domain segment is contained in the frequency parameters of the corresponding sinusoids. A transient in the beginning of a segment results in low sinusoidal frequencies, while a transient in the end of the segment results in high sinusoidal frequencies. The frequency resolution of the sinusoidal model depends on the required resolution in estimation of transient locations. If the required time resolution is one sample then the required frequency resolution is defined by the reciprocal of the DCT size.

Due to the duality between the transient location in a time domain segment and the frequencies of the corresponding sinusoids, the obvious way to modify the transient location is to modify the corresponding frequencies (plus a correction in the phase parameters). The transient location in the time domain segment is denoted by no and the closest allowed location from a time grid is denoted by ñ. Then the desired time shift is defined as $$\Delta n = n_0 - \hat{n} \tag{2}$$

In order to modify the transient location by Δn the frequencies $\omega_{i,j}$ and phases $\varnothing_{i,j}$ corresponding to the transient should be modified as follows:

$$\hat{\omega}_{i,j} = \omega_{i,j} - \frac{\Delta n \pi}{N}, \tag{3}$$

$$\hat{\phi}_{i,j} = \phi_{i,j} + \frac{\Delta n \pi}{N}\left(\frac{L-1}{2} + (i-1)\frac{L}{2}\right) \tag{4}$$

No modification of amplitudes $A_{i,j}$ is needed.

Note that the above procedure is different from independent quantization of sinusoidal parameters. All frequencies corresponding to one transient are modified by the same amount. This, together with the phase correction of equation (4) above, ensures that the shape of the time domain transient is preserved, only the location is modified.

Because the DCT size is relatively large at one second, more than one transient can occur in a time domain segment. In this case, the model has to identify sinusoidal parameters corresponding to different transients. This is done by declaring close sinusoidal frequencies $\omega_{i,j}$ to represent the same transient. Specifically, two sinusoids having frequencies differing by not more than $\epsilon_\omega$ are declared to represent the same transient and two sinusoids having frequencies differing by more than $\epsilon_\omega$ are declared to represent different transients. Then locations of all transients are modified separately. Below when reference is made to a group of frequencies $\omega_{i,j}$ reference is being made to frequencies corresponding to a particular transient.

A transient can occur at the beginning or at the end of a time domain segment. In this case, the modification of sinusoidal frequencies can yield frequencies below 0 or above π. This results in the distortion of the shape of the time domain transient. To account for this, an overlap is allowed between time domain segments (0.1 seconds). In this case a transient can appear in two overlapping segments, i.e. in the region of mutual overlap. Because the overlap is sufficiently large, if the transient is located very close to a border of one of the overlapping segments, then it is located at a safe distance from a border of the other segment. It is straightforward to identify the transient location from sinusoidal frequencies, and therefore it is easy knowing the estimated sinusoidal frequencies in the two overlapping segments to identify when a transient is represented in two segments. If such a situation occurs, the corresponding sinusoids in the segment are cancelled where the transient is closer to the corresponding border.

A typical transient lasts for more than one time sample. A natural question is then what is the location of $n_0$ of the transient. After the modification of location the corresponding sample of the transient will be placed at location $\hat{n}$ corresponding to the beginning of a segment defined by the time grid. Therefore, it is important that the estimated value $n_0$ corresponds to the start of the transient. The time domain approach described below has proved to yield good results. First, the time samples $n_{min}$ and $n_{max}$ are identified corresponding to the frequency values $\min(\omega_{i,j})$ and $\max(\omega_{i,j})$, where $\omega_{i,j}$ are frequencies of sinusoids corresponding to a particular transient. Next, the highest amplitude of the estimated transient signal in the time interval $[n_{min}, n_{max}]$ is found. Then, the start sample of the transient $n_0$ is defined to be the first sample in the interval $[n_{min}, n_{max}]$ having amplitude higher than 10% of the highest amplitude.

Typically, the estimated transient component of an audio signal contains samples of small amplitudes before the sample $n_0$. Because the time sample $n_0$ is declared to be the first sample of the transient and that no transient can occur at a distance defined by $\epsilon_\omega$ before the transient, the corresponding samples before $n_0$ are forced to have zero amplitude. As a result, those samples go to the residual signal with their original amplitudes.

Having estimated the location of transients and modifying their location as described above the modified signal can now be modeled to allow the signal to be coded.

A damped sinusoidal model is used to model the modified signal, which aims at approximating a signal s with a sum of sinusoids with exponentially modulated amplitudes, i.e.

$$\hat{s}(n) = \sum_{m=1}^{2M} B_m e^{\alpha_m n} \cos(\upsilon_m n + \psi_m) = \sum_{m=}^{M} r_m p_m^n,\ n = 0, \ldots, K-1 \tag{5}$$

where $r_m$, $p_m \in C.K \in N$ is the segment length. Equation 5 expresses $\hat{s}(n)$ as the sum of M damped (complex) exponentials. The parameter $r_m$ determines the initial phase and amplitude, while $p_m$ determines the frequency and damping. In order to determine the parameters $r_m$ and $p_m$ for the M exponentials the matching pursuit algorithm was used, as described in "Matching pursuits with time-frequency dictionaries", IEEE Transactions of Signal Processing, Volume 41, pp 3397–3415, December 1993. Matching pursuit approximates a signal by a finite expansion into elements chosen from a redundant dictionary. Let $D=(g_\gamma)_{\gamma\in\Gamma}$ be a complete dictionary of unit-norm elements. The matching pursuit algorithm is a greedy iterative algorithm which projects a signal s onto the dictionary element $g_\gamma$ that best matches the signal and subtracts this projection to form a residual signal to be approximated in the next iteration. Finding the best matching dictionary element consists of computing the inner products $<s, g_\gamma>$ and selecting the element that maximises the inner product. In order to find the parameters $r_m$ and $p_m$ a dictionary is constructed consisting of damped exponentials, $$g_{\alpha,\nu} = ce^{\alpha n} e^{i\nu n},\ n=0, \ldots, K-1 \tag{6}$$

Where the constant c is introduced for having unit-norm dictionary elements, and compute the inner products of the residual signal at iteration m, $S_m$ and the dictionary elements defined in equation 6:

$$\langle s_m, g_{a,v} \rangle = c \sum_{n=0}^{K-1} s_m(n) e^{\alpha n} e^{-i\nu n},$$

By doing this for different values of $\alpha$, the transfer function $S_m(z)$ is evaluated on circles in the complex z-plane having radius $e^\alpha$.

The method described above has been experimentally tested and the following gives results and discussion of computer simulations and informal listening tests performed on audio signals. The audio excerpts used were a castanet signal, songs by ABBA, Celine Dion, Metallica and a vocal by Suzanne Vega. The signals were sampled at 44.1 kHz. The DCT size is 44288 samples (approximately 1 second) and the overlap between time domain segments is 4410 samples (0.1 seconds). The sinusoidal analysis of the DCT domain signals is done using Hanning windows of length 512 samples and mutual overlap of 256 samples. The transient component of the signal was estimated and subtracted to form the residual signal. Next, the transient locations were modified according to a time grid of 220 samples (approximately 5 ms).

It is important to verify that the modification of the transient locations does not introduce any audible distortion. To check that, the modified transient signal was added to the residual signal. The listening tests conducted verified that there is no perceptual difference between the thus obtained signal and the original audio signal.

Figure 1:
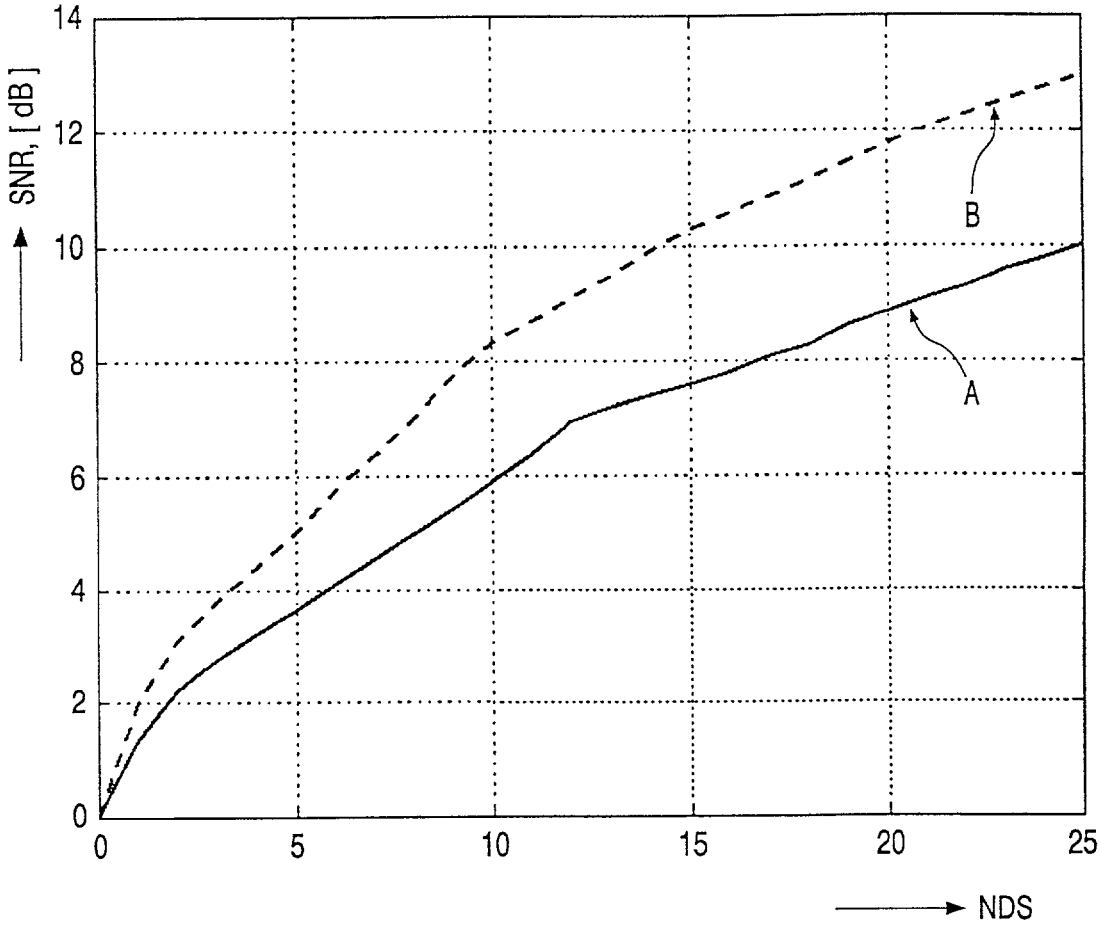
FIG. 1 shows the performance of a damped sinusoidal model in the case of a restricted segmentation of an audio signal for an original and a time shifted transient for a first embodiment.
Figure 2:
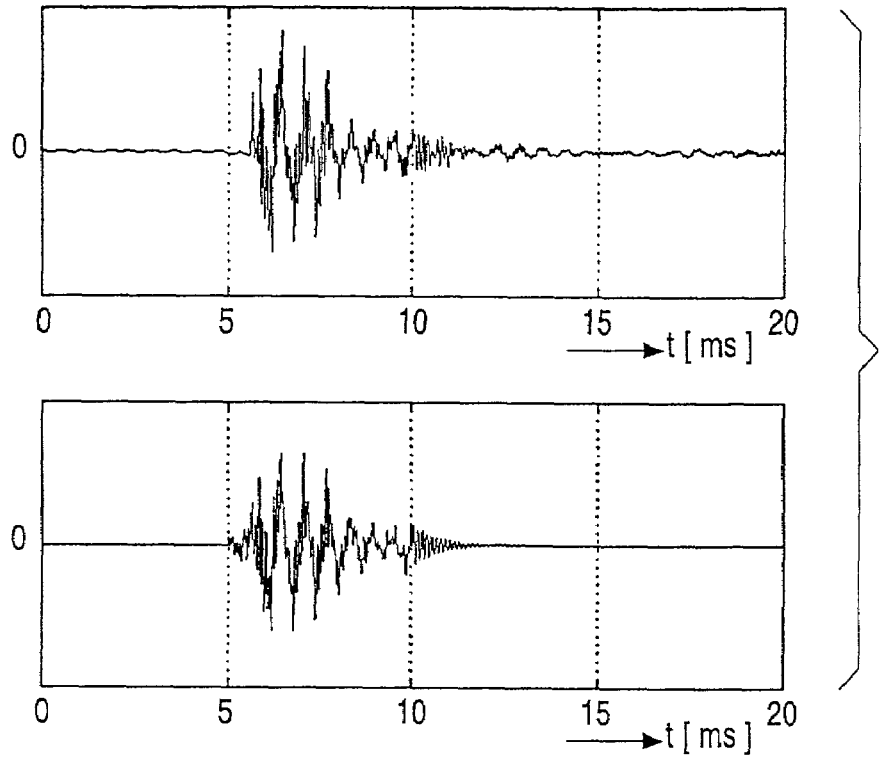
FIG. 2 shows an original transient and its reconstruction with 25 damped sinusoids.
Figure 3:
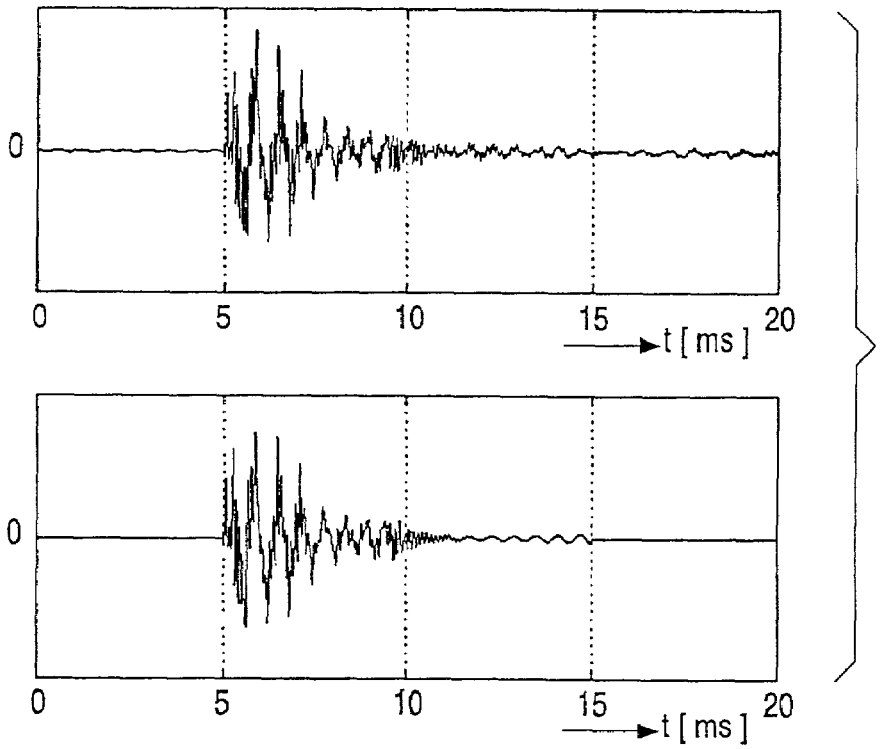
FIG. 3 shows a time shifted transient and its reconstruction with 25 damped sinusoids for the first embodiment.

In the following, the improvement due to the modification procedure will be illustrated. Also discussed is the performance of a damped sinusoidal model with the restricted segmentation for an original transient signal (i.e. generally a transient starts at an arbitrary location) and the modified transient signal (a transient starts in the beginning of a segment). The optimal restricted time segmentation (with the minimum segment size of 220 samples) for damped sinusoids is found using the technique proposed in "Flexible tree-structured signal expansions using time-varying wavelet packets" in IEEE Transactions of Signal Processing, Volume 45, pp 333–345, February 1997. The performance is studied in terms of signal-to-noise ratio (SNR) versus number of damped sinusoids NDS and is well illustrated by FIG. 1 where results are presented for a particular transient of the castanet signal; A represents the original transient and B represents the shifted transient. The modification procedure results in a considerably smaller number of damped sinusoids needed to represent the transient with a certain quality than would previously have been the case. Lower plots of FIGS. 2 and 3, show the reconstruction with 25 damped sinusoids of the original and the modified transients, respectively. In these Figures t[ms] denotes time in milli-seconds. The original transient is not located in the beginning of the segment and, as a result, the modeling error is distributed to samples before the transient. This results in an audible pre-echo. On the other hand, the modified transient is located in the beginning of the segment and, as a result, the pre-echo problem is eliminated.

FIG. 4 shows a flow diagram of the first embodiment having steps S1 to S6, where:

S1 represents: Estimate the location of transients in a first time segment of an input signal, by a transformation into the frequency domain.

S2 represents: Modify the location of the transients in the spatial domain by modifying the corresponding frequencies, to locations on a predetermined time scale.

S3 represents: Estimate the location of transients in second and subsequent time segments of the transient signal, by a transformation into the frequency domain.

S4 represents: Modify the location of the transients in the spatial domain by modifying the corresponding frequencies, to locations on a predetermined time scale.

S5 represents: Decompose an audio signal into transient, tonal and noise components.

S6 represents: Recombine the decomposed signal for transmission or playback.

It may be possible that a similar improvement to that mentioned above would be achieved in the case of a full-precision variable segmentation (and no signal modification). However, the restricted segmentation and the modification procedure result in a much lower total computational cost. Also, less side information is required to describe the restricted segmentation.

A second embodiment of coding method involves a different method of estimating the location of transients in an input signal and a different modification procedure. The locations of transients are modified in such a way that a transient can only occur at the beginning of a sinusoidal segment, which sinusoidal segments are defined by a specified segment size, which may be 5 milliseconds (ms); this is referred to as a restricted segmentation, and corresponds to that of the first embodiment. The reference to a beginning of a sinusoidal segment can be taken to be a reference to a beginning of a time grid in the first embodiment; the reference to a sinusoid simply refers to the modeling procedure used.

This second embodiment uses the same idea as the first embodiment in that transient locations are modified to improve the modeling of signals, in particular, audio signals. However, this second embodiment provides an improved method of modifying the location of transients.

To summarize the first method, the input signal was modified by estimating the location of transient components using a model based on the duality between the time and frequency domain for the signal; subtracting the transient component; modifying the locations of transients such that their beginnings can only occur at the beginnings of sinusoidal segments and a restricted segmentation; and adding the modified transient to the residual signal in order to obtain a modified audio signal.

In outline, the method of the second embodiment involves detecting the beginnings and ends of transient and audio signal using an energy based approach with two sliding rectangular windows, as described in "Audio subband coding with improved representation of transient signal segments", from proceedings of EUSIPCO, pages 2345–2348, Greece 1998, incorporated herein by reference; followed by moving the identified transients to locations specified by a chosen time grid or sinusoidal segmentation grid; and time-warping parts of the signal between the identified transients in order to fill the intervals between the modified transients.

The transient detection approach as described in "Audio subband coding with improved representation of transient signal segments" mentioned above, is based on the evaluation of the criterion function, C(n):

$$C(n) = \log\left(\frac{E_R(n)}{E_L(n)}\right) \cdot E_R(n), \quad E_L(n) = \sum_{k=n-N}^{n-1} s^2(k),$$

$$E_R(n) = \sum_{k=n+1}^{n+N} s^2(k),$$

where n is a time sample, $E_L(n)$ and $E_R(n)$ are the energies of the input signal within length-N rectangular windows on the left- and right-hand side of the time sample n. Significant peaks of the criterion function C(n) correspond to the beginnings of transients. The end of a transient is defined by searching the first value of C(n) after the beginning of a transient, which is just below a certain threshold.

Once the beginnings and ends of the transients have been located using the above method the transients are simply removed from the signal and relocated to the nearest location on the specified sinusoidal segmentation grid, effectively by a cut and paste method. This part of the procedure is particularly straightforward and is easily implemented by the person skilled in the art.

Figure 5A:
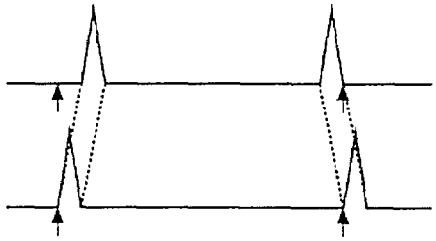
FIG. 5 is a diagrammatic illustration of the modification of transient location in a second embodiment.

As would be appreciated, due to the modification of the transient locations, the distance between two consecutive transients in an audio signal can become longer (e.g. if one is shifted forward and the other is shifted backward), or the distance can become shorter (e.g. if a first transient is shifted backwards and a second transient is shifted forwards in time). In FIG. 5 examples of transient modification where the distance is increased is shown, whereas in FIG. 6, a reduced distance between transients is shown. In order to fill the interval between the modified transients the signal part in between must be modified in some way to allow for the greater or smaller distance between transients.

The signal is modified by time-warping, this is done in such a way that preserves the correct amplitudes of the edge points of the signal in between the transients, thus there are no discontinuities introduced just before or just after a transient, as described below. The time-warping results in the signal between transients being stretched (as shown in FIG. 5) or compressed (as shown in FIG. 6). To compute the amplitudes at the new integer sampling positions based on the known amplitudes of the original samples, a band limited interpolation method based on sinc functions is used (the bandlimited interpolation is described in Proakis and Manolakis "Digital Signal Processing. Principles, Algorithms and Applications", Prentice-Hall International, 1996). Modified Hanning window is used. To compute the amplitude of each new sample, amplitudes of eight original samples are used, four at each side of the new sample.

The stretching or compressing of a signal results for tonal signals in a corresponding change of the fundamental frequency, $f_0$. The goal of the modification procedure is to ensure that the induced modifications of $f_0$ are not audible.

In order to achieve the modification, the following algorithm is used for time-warping the part of the signal between the two identified and modified transients;

(a) if the required change in length of a signal part in between two transients results in a change of $f_0$ by no more than 0.2%, the signal is simply subjected to a band limited interpolation method based on sinc functions. This is the example shown in FIGS. 5*a* and 6*a*. If $f_0$ changes by more than 0.2% then follow step b) as described below.

The reason for the limit of 0.2% is that it has been determined from the literature on psycho-acoustics that changing $f_0$ of a tonal sound by 0.2% can be audible, as described in "An introduction to the psychology of hearing", Academic Press, 1997. Our own experiments verify this result.

Figure 5B:
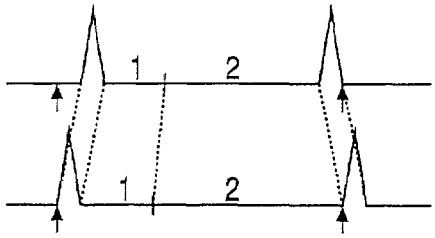
Figure 6A:
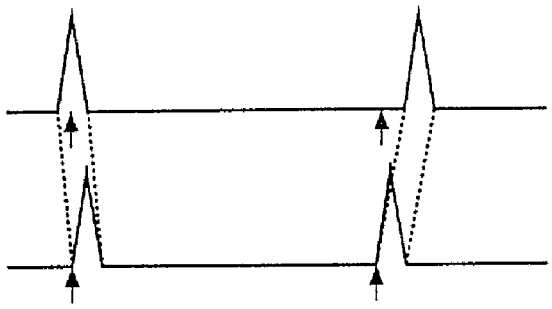
FIG. 6 is a diagrammatic illustration similar to that of FIG. 5.
Figure 6B:
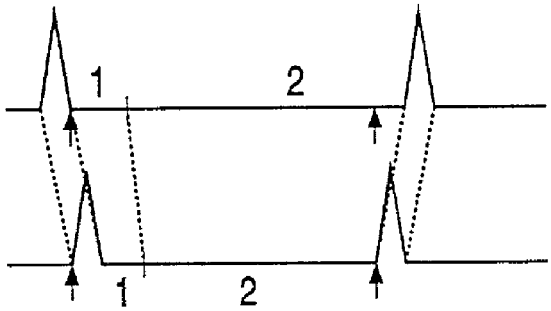

(b) The signal part is split in between two transients into two non-overlapping intervals; the first interval is located directly after the end of the first transient and lasts 10 ms (as illustrated by interval 1 in FIGS. 5*b* and 6*b*), and the second interval is the remaining part, i.e. it lasts until the beginning of the second transient (as shown by interval 2 in FIGS. 5*b* and 6*b*). The lengths of the two intervals are modified by a different amount. If the required change in length of the signal part in between two transients can be done by changing $f_0$ in the first interval by no more than 2% and in the second interval by no more than 0.2%, then the signal in the two intervals is time-warped correspondingly as shown in the lower parts of FIGS. 5*b* and 6*b*. Otherwise go to step c) as described below.

The reasoning behind step b) is that the interval directly after the end of a transient is the interval where the masking effect from the transient is strong. Therefore, larger changes of the signal in this interval are possible before they become audible. Our experiments verify that a change of $f_0$ by no more than 2% in the interval 10 ms directly after the end of a transient is inaudible.

Figure 5C:
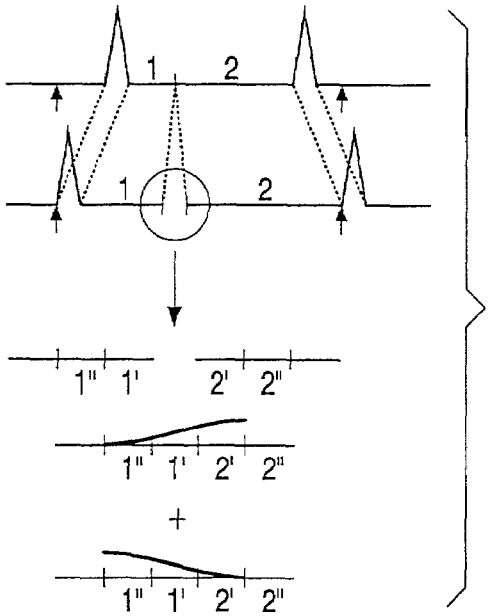

(c) time-warp the signal in the two intervals such that the resulting change of $f_0$ is no more than 2% in the interval 1 and no more than 0.2% in the interval 2. If the resulting change in length is not sufficient to fill the distance between the shifted transients then apply an overlap-add procedure with a modified Hanning window using samples from the two intervals in order to increase or decrease the length of the signal. To ensure a smooth transition between two intervals, the length of the overlap-add region is chosen to be larger than required to obtain a correct length of the signal in between two transients (FIGS. 5*c* and 6*c*).

Figure 6C:
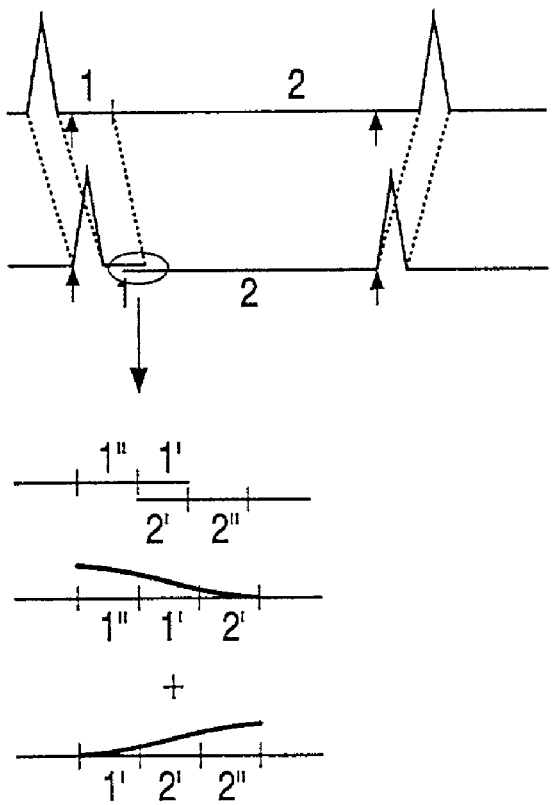

In FIGS. 5 and 6 the new locations of transient beginnings are depicted with small arrows. In FIG. 5 the signal part in between two transients becomes longer. In FIG. 6 the signal part in between two transients becomes shorter. In the lower part of FIG. 6*c* a small vertical shift is shown for clarity's sake.

Various computer simulations of the method of the second embodiment, together with informal listening tests with audio signals were carried out. The audio excerpts used were castanets, bass, trumpet, Celine Dion, Metallica, harpsichord, Eddie Rabbit, Stravinsky and Orff. The signals were sampled at 44.1 kHz. The transient locations were modified according to a time grid of 220 samples (approximately 5 ms). It is important to verify that the modification of transient locations does not introduce any audible distortion. The listening tests conducted verified that there is no perceptual difference between the original and modified audio signals.

Figure 7:
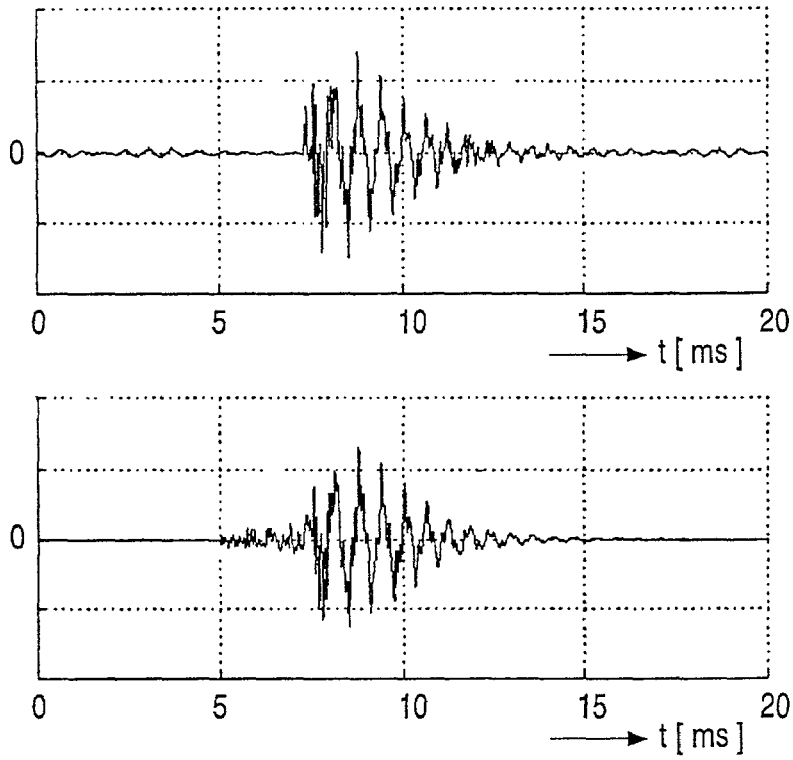
FIG. 7 shows an original transient and its reconstruction.
Figure 8:
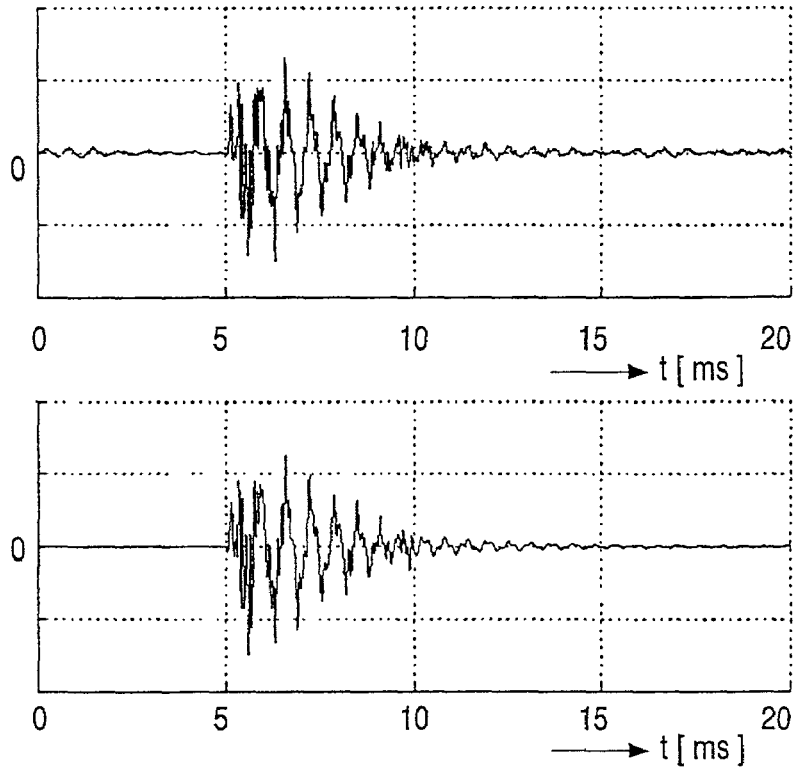
FIG. 8 shows a shifted transient and its reconstruction according to the second embodiment.

Next, it was demonstrated that there is an improvement in the modeling of the signal due to the modification procedure. A comparison was made between the performance of a damped sinusoidal model with the restricted segmentation for an original transient signal (i.e. generally transient starts at an arbitrary location) and for a modified transient signal (a transient starts at the beginning of a segment, as defined by the present method). The lower parts of FIGS. 7 and 8 show the reconstruction with 25 damped sinusoids of the original and the modified transients, respectively. The original transient is not located at the beginning of the segment, and as a result, the modeling error is distributed to samples before the transient. This results in an audible pre-echo, shown by the amplitude of the signal and the lower part of FIG. 7 between 5 ms and approximately 7.5 ms, which is not shown in the upper part of the FIG. 7 that shows the original transient. On the other hand, the modified transient is located at the beginning of the segment and, as a result, the pre-echo is eliminated as demonstrated in FIG. 8 in that the amplitude of the signal for upper and lower parts of the figure moves from zero immediately after 5 ms, i.e. both at the same time.

Figure 9:
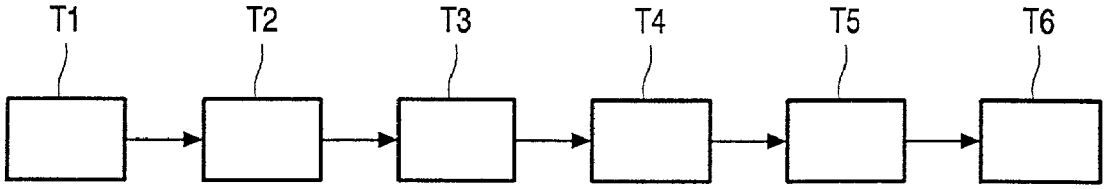
FIG. 9 is a flow diagram of the steps involved in the second embodiment.

FIG. 9 shows a flow diagram of the second embodiment having steps T1 to T6, where:

T1 represents: Estimate the location of transients (beginning and end) in a first time segment of an input signal, by an energy based approach.

T2 represents: Modify the location of the transients by cutting and pasting to locations on a predetermined time scale, and timewarp the signal parts in between.

T3 represents: Estimate the location of transients (beginning and end) in second and subsequent time segments of the input signal.

T4 represents: Modify the location of the transients as above, and timewarp the signal parts in between.

T5 represents: Decompose the audio signal into transient, tonal and noise components.

T6 represents: Recombine the decomposed signal for transmission or playback.

The method described in the second embodiment provides a more general procedure and provides good results, which are an improvement on those of the first embodiment. The time-warping principal is based on the knowledge of sound perception and the procedure of the second embodiment is less complex to implement and utilize.

The advantages of the second embodiment over prior art methods and also the first embodiment are that the transient detection model is more general and provides good results for various transients, not just short transients. Also, the time-warping of the signal parts between transients is based on the knowledge of the properties of sound perception, such as pitch perception and temporal masking effects. Furthermore, the method of the second embodiment results in a significantly lower computational complexity.

Both of the methods disclosed herein provide a particularly advantageous method for coding audio and video signals. In particular, restricting the transient locations simplifies the analysis procedure in an audio coder (involving transient, sinusoidal and noise models) significantly. Also, the side information associated with the corresponding segmentation is reduced because of the restricted segmentation often used in the two embodiments described.

Furthermore, the introduced difference in transient locations is not of perceptual importance.

Figure 10:
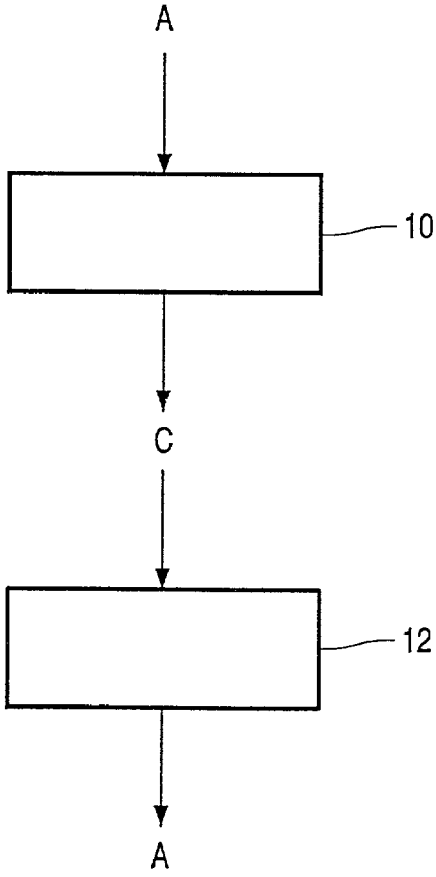
FIG. 10 is a schematic diagram of an audio encoder and an audio decoder utilizing the methods described herein.

The method could be implemented in devices for storing, transmitting, receiving, or reproducing audio and/or video, e.g. solid state audio devices. FIG. 10 shows an audio coder 10 and an audio decoder 12 which receive an audio signal (A) for coding and a coded signal (C) for decoding respectively, with the decoder 12 outputting the audio signal A. In particular, the audio coder may be included in a transmitting or recording device, further comprising a source or receiver for obtaining the audio signal and an output unit for transmitting/outputting the coded signal to a transmission medium or a storage medium (e.g. a sold state memory). For stereo audio signals, the time and intensity with which a signal reaches both ears play a major role on localization of sounds, i.e. the perception of direction and distance to the sound source. More precisely, it is the difference in time (interaural time difference) and difference in intensity (interaural intensity difference) with which the signal reaches both ears, which form the so called stereo image. Here, we deal with time modifications of audio signals for the purpose of efficient modeling. Therefore, below we will concentrate our attention on the resulting interaural (interchannel) time differences.

The audibility of interchannel time difference and relative importance of transients and ongoing parts in formation of stereo image depend upon a variety of factors, including duration of sounds, frequency content, repetition rate (for transients). The important result, however, is that interchannel time differences as small as of order of 10 μs is can be detected by the auditory system (using cues either from transients or ongoing parts).

When modifying transient locations, also the ongoing parts are modified due to the time shift and time warping, i.e. both important cues are present. Therefore, care has to be taken for not destroying the original stereo image.

An efficient modeling with damped sinusoids can be obtained if transient locations in both stereo channels are modified such that the transients start at the beginnings of the sinusoidal segments. The independent modifications in the two channels would, however, generally result in a destroyed stereo image. A possible solution to this problem could be to modify the transient locations according to the sinusoidal segmentation before modeling with damped sinusoids, but to send side information describing the original time differences between corresponding transients in the two channels to the decoder. The, at the decoder the synthesized signal in one of the channels can be unwarped according to the original time difference. As a result, the synthesized transients occur generally at locations different from their original locations but the interchannel time difference between the two transients is preserved. This solution is especially suitable for highly-correlated stereo channels, having similar detected transients with low interchannel time differences.

It should be noted that the above-mentioned embodiments illustrate rather than limit the invention, and that those skilled in the art will be able to design many alternative embodiments without departing from the scope of the appended claims. In the claims, any reference signs placed between parentheses shall not be construed as limiting the claim. The word 'comprising' does not exclude the presence of other elements or steps than those listed in a claim. The invention can be implemented by means of hardware comprising several distinct elements, and by means of a suitably programmed computer. In a device claim enumerating several means, several of these means can be embodied by one and the same item of hardware. The mere fact that certain measures are recited in mutually different dependent claims does not indicate that a combination of these measures cannot be used to advantage.

In summary, an improved representation of transients in audio signals comprises modifying transient locations in such a way that a transient can occur only at a beginning of a sinusoidal segment. The modification procedure comprises the steps:

detecting a beginning and an end of a transient using an energy-based approach with two sliding rectangular windows;

moving samples between the beginning and the end of the transient to the locations specified by the segmentation used; and time-warping the signal parts in between the transients in order to fill the intervals between the modified transients.

What is claimed is:

1. A method of coding an input signal, comprising:

estimating a location of at least one transient in a time segment of the input signal;

modifying the location of each transient so that the transient occurs at a specified location on a predetermined time scale to obtain a modified signal; and modeling the modified signal.

2. A method of coding as claimed in claim 1, wherein each transient is relocated to a nearest specified location of a plurality of possible locations on the predetermined time scale.

3. A method of coding as claimed in claim 2, wherein the plurality of possible locations on the predetermined time scale are defined by integer multiples of a predetermined minimum time segment size.

4. A method of coding as claimed in claim 3, wherein the predetermined minimum time segment size has a length in a range of approximately 1 millisecond (ms) to approximately 9 ms.

5. A method of coding as claimed in claim 1, wherein modeling the modified signal comprises using sinusoids to represent the modified signal.

6. A method of coding as claimed in claim 1, further comprising applying a restricted time segmentation to at least one of tonal and noise components of the input signal.

7. A method of coding as claimed in claim 1, wherein estimating the location of the at least one transient comprises using an energy-based approach.

8. A method of coding as claimed in claim 7, wherein estimating the location of the at least one transient comprises using two sliding windows.

9. A method of coding as claimed in claim 1, wherein the location of the at least one transient comprises the location of a beginning and an end of each transient.

10. A method of coding as claimed in claim 1, wherein modifying the location of each transient comprises cutting and pasting at least one transient from its original location to begin at a specified location on the predetermined time scale.

11. A method of coding as claimed in claim 10, further comprising time-warping a remaining section of the input signal between two transients to fill a gap remaining following movement of the at least one transient.

12. A method of coding as claimed in claim 11, wherein the time-warping comprises one of lengthening and shortening the remaining section.

13. A method of coding as claimed in claim 11, wherein the time-warping preserves amplitudes of edge points of the modified signal.

14. A method of coding as claimed in claim 11, wherein the time-warping comprises using interpolation, where a change in a fundamental frequency of the remaining section is less than approximately 0.3%.

15. A method of coding as claimed in claim 11, wherein, where a change in a fundamental frequency of the remaining section is more than or equal to 0.3%, the remaining section is split into a first portion and a second portion.

16. A method of coding as claimed in claim 15, wherein the first portion is approximately 8 ms to 12 ms.

17. A method of coding as claimed in claim 14, further comprising using an overlap-add procedure where the interpolation is insufficient to fill the gap in the remaining section.

18. A method of coding as claimed in claim 1, wherein modifying the location of each transient comprises using a transformation into a frequency domain.

19. A method of coding as claimed in claim 1, further comprising including side information in the modeled modified signal, wherein the side information describes an original time difference between corresponding transients in at least two channels.

20. A method of decoding, comprising:

receiving a modeled modified signal, wherein a location of transients in at least two channels has been modified, the modeled modified signal further comprising side information describing an original time difference between corresponding transients;

synthesizing a synthesized signal for the at least two channels; and unwarping the synthesized signal according to the original time difference.

21. A transmission medium comprising a modeled modified signal, wherein a location of transients in at least two channels has been modified, the signal further comprising side information describing an original time difference between corresponding transients in the at least two channels.

22. A storage medium comprising a modeled modified signal received over a transmission medium as claimed in claim 21.

23. A decoder comprising:

means for receiving a modeled modified signal, wherein a location of transients in at least two channels has been modified, the signal further comprising side information describing an original time difference between corresponding transients in the at least two channels, and means for synthesizing a synthesized signal for the at least two channels and unwarping the synthesizing signal according to the original time difference.

24. An audio player comprising a decoder as claimed in claim 23 and a reproduction unit for reproducing an unwarped synthesized signal.

25. An apparatus for coding signals, comprising an electronic processor operable to:

estimate a location of one or more transients in a time segment of an input signal;

modify the location of each transient so that each transient occurs at a specified location on a predetermined time scale; and model the modified input signal.

26. The apparatus as claimed claim 25, wherein the apparatus comprises an audio device.

* * * * *